US006822527B2

(12) United States Patent
Shimizu

(10) Patent No.: US 6,822,527 B2
(45) Date of Patent: Nov. 23, 2004

(54) ISOLATOR FOR GREATLY ATTENUATING SIGNAL TRANSMITTED IN REVERESE DIRECTION OVER WIDE FREQUENCY BAND

(75) Inventor: Yuichi Shimizu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/655,187

(22) Filed: Sep. 4, 2003

(65) Prior Publication Data

US 2004/0047555 A1 Mar. 11, 2004

(30) Foreign Application Priority Data

Sep. 9, 2002 (JP) ..... 2002-262353

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 4,246,552 A * 1/1981 Fukasawa et al. ..... 333/1.1
5,994,974 A * 11/1999 Makino et al. ..... 333/24.2
6,734,753 B2 * 5/2004 Kawanami et al. ..... 333/24.2

FOREIGN PATENT DOCUMENTS

JP 2002-111319 4/2002

* cited by examiner

*Primary Examiner*—Stephen E. Jones
(74) *Attorney, Agent, or Firm*—Brinks Hofer Gilson & Lione

(57) ABSTRACT

An isolator has a magnetic core of a plate shape placed within a direct current magnetic field and having an upper face perpendicular to the direction of the direct current magnetic field, and first to third central conductors overlapping other at an equal angle interval approximately in the central portion of the upper face of the magnetic core, and having one end connected to the ground. The other end of the first central conductor is an input terminal, and the other end of the second central conductor is an output terminal. At least the third central conductor is constructed by two parallel band-shaped conductors. One end of one band-shaped conductor is connected to the ground by a first resistor and a first capacitor. The other end of the other band-shaped conductor is connected to the ground by a second resistor and a second capacitor. The capacity value of the first capacitor and the capacity value of the second capacitor are different from each other.

2 Claims, 2 Drawing Sheets

ISOLATOR FOR GREATLY ATTENUATING SIGNAL TRANSMITTED IN REVERESE DIRECTION OVER WIDE FREQUENCY BAND

BACKGROUND OF THE INVENTION

1. Field of the Invention

The present invention relates to an isolator utilizing the Faraday effect.

2. Description of the Related Art

FIG. 4 shows a main portion of a conventional isolator. A magnetic core 21 constructed by ferrite of a disc shape such as YIG, etc. is placed within a direct current magnetic field generated from an unillustrated permanent magnet, and its upper face is perpendicular to the direction of the direct current magnetic field. Three central conductors (first central conductor 22, second central conductor 23 and third central conductor 24) are placed on the upper face of the magnetic core 21, and are held so as to be overlapped with each other at an equal angle interval (120°) by mutually holding their insulations approximately in the central portion of the upper face of the magnetic core 21. Their lengths are approximately equal to each other so that their inductance values are also approximately equal to each other.

Each of the central conductors 22 to 24 is constructed by two parallel band-shaped conductors, and one end of each central conductor is connected to the ground. The other end 22*a* of the first central conductor 22 is set to an input terminal, and the other end 23*a* of the second central conductor 23 is set to an output terminal. The other ends 22*a*, 23*a* are respectively connected to the ground by capacitors 25, 26 for matching.

On the other hand, the other end 24*a* of the third central conductor is connected to the ground by a terminal end resistor 27 and a terminal end capacitor 28.

In the above construction, a signal inputted to the other end 22*a* of the first central conductor 22 is outputted to the other end 23*a* of the second central conductor 23 by the Faraday effect.

However, a signal of the reverse direction inputted to the other end 23*a* of the second central conductor 23 is oppositely absorbed by the third central conductor 24 and the terminal end resistor 27 and the terminal end capacitor 28 connected to this third central conductor 24, and is not outputted to the other end of the first central conductor 22. A transmitting state of this signal of the reverse direction will be explained by FIG. 5 constructed by replacing this transmitting state with an equivalent electric circuit.

In FIG. 5, an inductance element 31 connected to the other end 23*a* of the second central conductor 23 is represented by the third central conductor 23, and an inductance element 32 connected to the other end 22*a* of the first central conductor 22 is represented by the first central conductor 22. A capacity element 33 between the two inductance elements 31 and 32 is represented by a coupling capacitor between the two central capacitors 22 and 23.

One end of an inductance element 34 represented by the third central conductor 24 is connected to both ends of the capacitor element, and the other end is connected to the ground by the terminal end resistor 27 and the terminal end capacitor 28. Accordingly, a series resonance circuit is constructed by the inductance element 34 and the terminal end capacitor 28, and a signal is greatly attenuated at a resonance frequency F0 as shown in FIG. 3.

However, since a frequency band for attenuating the signal transmitted in the reverse direction is narrow in the above construction, a problem exists in that the attenuating amount R is reduced with respect to the signal transmission of a wide frequency band (from F1 to F2) and the signal level reflected to the input terminal is increased.

SUMMARY OF THE INVENTION

An object of the present invention is to provide an isolator for greatly attenuating the signal transmitted in the reverse direction over the wide frequency band.

To solve the above problem, the present invention resides in an isolator comprising a magnetic core of a plate shape placed within a direct current magnetic field and having an upper face perpendicular to the direction of the direct current magnetic field, and first to third central conductors placed so as to be overlapped with each other at an equal angle interval approximately in the central portion of the upper face of the magnetic core, and respectively having one end connected to the ground, wherein the other end of the first central conductor is set to an input terminal, and the other end of the second central conductor is set to an output terminal, and at least the third central conductor is constructed by two parallel band-shaped conductors, and the other end of one band-shaped conductor is connected to the ground by a first resistor and a first capacitor, and the other end of the other band-shaped conductor is connected to the ground by a second resistor and a second capacitor, and the capacity value of the first capacitor and the capacity value of the second capacitor are set to be different from each other.

Further, each of the first central conductor and the second central conductor is constructed by two parallel band-shaped conductors, and the respective distances between the two band-shaped conductors in the first to third central conductors are equally arranged.

DESCRIPTION OF THE PREFERRED EMBODIMENTS

Figure 1:
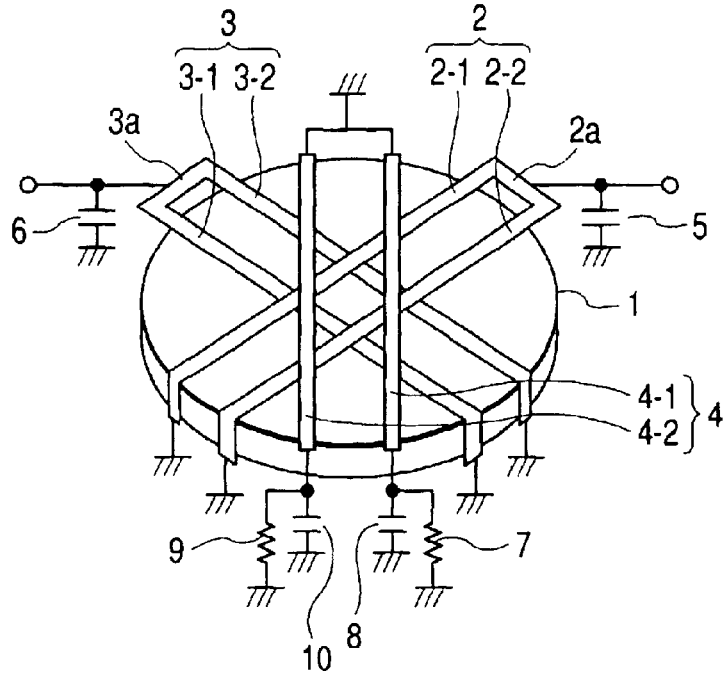
FIG. 1 is an exploded perspective view of a main portion in a first embodiment mode of an isolator of the present invention.

FIG. 1 shows an embodiment mode of the present invention. A magnetic core 1 constructed by ferrite of a disc shape such as YIG, etc. is placed within a direct current magnetic field generated from an unillustrated permanent magnet, and its upper face is perpendicular to the direction of the direct current magnetic field. Three central conductors (first central conductor 2, second central conductor 3 and third central conductor 4) are placed on the upper face of the magnetic core 1, and are held so as to be overlapped with each other at an equal angle interval (120°) by mutually holding their insulations approximately in the central portion of the upper face of the magnetic core 1. Their lengths are approximately equal to each other so that their inductance values are also approximately equal to each other.

Each of the central conductors 2 to 4 is constructed by two parallel band-shaped conductors. Namely, the first central conductor 2 is constructed by band-shaped conductors 2-1, 2-2, and the second central conductor 3 is constructed by band-shaped conductors 3-1, 3-2, and the third central conductor 4 is constructed by band-shaped conductors 4-1, 4-2. One end of each of the band-shaped conductors in each of the central conductors 2 to 4 is connected to the ground. The other ends of the band-shaped conductors 2-1, 2-2 in the first central conductor 2 are connected to each other, and are set to an input terminal 2*a*. The other ends of the band-shaped conductors 3-1, 3-2 in the second central conductor 3 are connected to each other, and are set to an output terminal 3*a*. Each of the input terminal 2*a* and the output terminal 3*a* is connected to the ground by capacitors 5, 6 for impedance matching.

On the other hand, the other ends of the band-shaped conductors 4-1, 4-2 in the third central conductor 4 are not connected to each other, and the other end of one band-shaped conductor is connected to the ground by a first terminal end resistor 7 and a first terminal end capacitor 8. The other end of the other band-shaped conductor 4-2 is connected to the ground by a second terminal end resistor 9 and a second terminal end capacitor 10. The capacitance value of the first terminal end capacitor 8 and the capacitance value of the second terminal end capacitor 10 are different from each other. However, the resistance value of the first terminal end resistor 7 and the resistance value of the second terminal end resistor 9 may be set to be equal to each other or different from each other.

The distance between the two band-shaped conductors 2-1 and 2-2 in the first central conductor 2, the distance between the two band-shaped conductors 3-1 and 3-2 in the second central conductor 3, and the distance between the band-shaped conductors 4-1 and 4-2 in the third central conductor 4 are set to be equal to each other so that the central conductors 2, 3 and 4 are easily manufactured.

In the above construction, a signal inputted to the input terminal 2*a* of the first central conductor 2 is outputted to the output terminal 3*a* of the second central conductor 3. However, when the signal is oppositely inputted to the output terminal 3*a* of the second central conductor 3, no signal appears in the input terminal 2*a* of the first central conductor 2 since the transmission direction of the signal is reverse. The above non-reciprocal characteristics are obtained by the Faraday effect. It is considered that an equivalent circuit in the case of the reverse transmission direction of the signal is provided as shown in FIG. 2.

Figure 2:
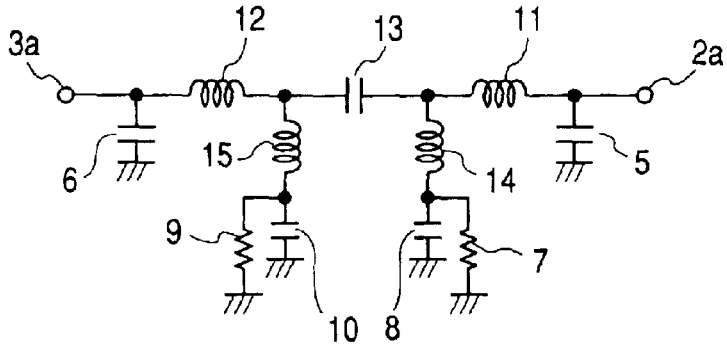
FIG. 2 is an equivalent circuit diagram in a signal transmitting state of the reverse direction in the isolator of the present invention.

In FIG. 2, an inductance element 11 connected to the input terminal 2*a* of the first central conductor 2 is represented by the first central conductor 2. An inductance element 12 connected to the input terminal 3*a* of the second central conductor 3 is represented by the second central conductor 3. A capacity element 13 between the two inductance elements 11 and 12 is represented by a coupling capacitor between the two central conductors 2 and 3.

Figure 3:
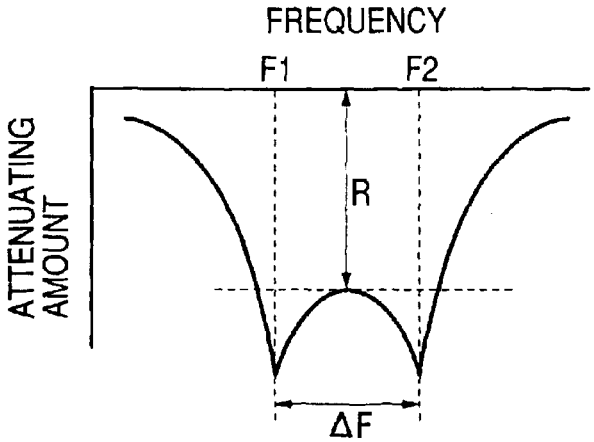
FIG. 3 is a characteristic view of the reverse direction signal transmission of the isolator of the present invention.
Figure 4:
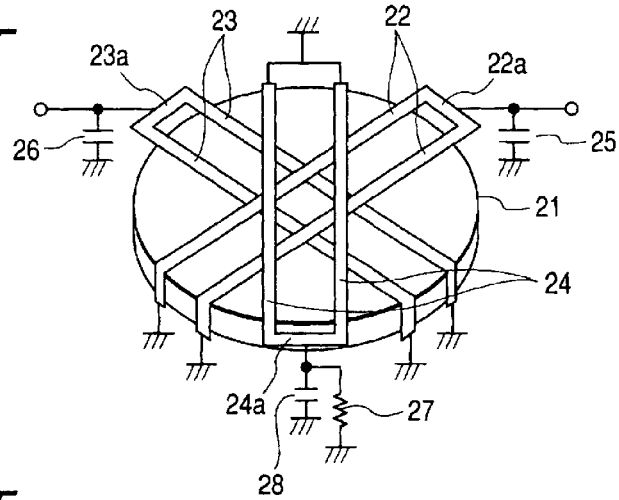
FIG. 4 PRIOR ART
FIG. 4 is an exploded perspective view of the main portion of a conventional isolator.
Figure 5:
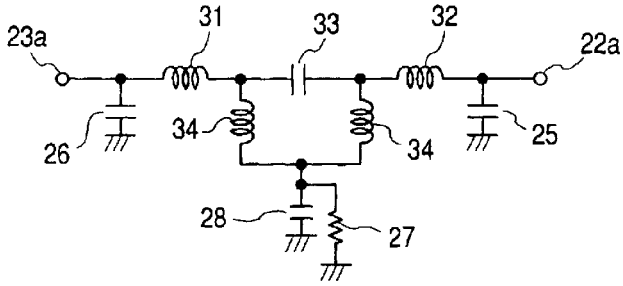
FIG. 5 PRIOR ART
FIG. 5 is an equivalent circuit diagram in the signal transmitting state of the reverse direction in the conventional isolator.
Figure 6:
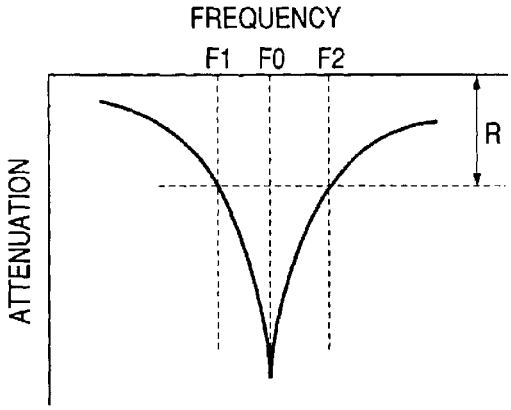
FIG. 6 PRIOR ART
FIG. 6 is a characteristic view of the reverse direction signal transmission of the conventional isolator.

Inductance elements 14, 15 respectively represented by the band-shaped conductors 4-1, 4-2 of the third central conductor 4 are connected to both ends of the capacity element 13. The other end of one inductance element 14 is connected to the ground by the first terminal end resistor 7 and the first terminal end capacitor 8. The other end of the other inductance element 15 is connected to the ground by the second terminal end resistor 9 and the second terminal end capacitor 10. As this result, one series resonance circuit is constructed by the inductance element 14 and the first terminal end capacitor 8. Another series resonance circuit is constructed by the inductance element 15 and the second terminal end capacitor 10. Here, the inductance values of the inductance elements 14,15 are approximately equal to each other in the structure of the band-shaped conductors 4-1, 4-2. However, mutual resonance frequencies are different from each other by setting the capacity value of the first terminal end capacitor 8 and the capacity value of the second terminal end capacitor 10 to be different from each other. Accordingly, as shown in FIG. 3, the signal transmission characteristics of the reverse direction are greatly attenuated at two resonance frequencies F1, F2, and are also greatly attenuated therebetween.

Accordingly, if the series resonance frequency provided by the inductance element 14 and the first terminal end capacitor 8 is set to F1 and the series resonance frequency provided by the inductance element 15 and the second terminal end capacitor 10 is set to F2, the signal transmission is prevented by the attenuating mount R of the reverse direction in the frequency band ΔF therebetween.

As explained above, in the present invention, an isolator comprises a magnetic core placed within a direct current magnetic field, and first to third central conductors placed so as to be overlapped with each other at an equal angle interval approximately in the central portion of the upper face of the magnetic core, and respectively having one end connected to the ground, wherein the other end of the first central conductor is set to an input terminal, and the other end of the second central conductor is set to an output terminal, and at least the third central conductor is constructed by two parallel band-shaped conductors, and the other end of one band-shaped conductor is connected to the ground by a first resistor and a first capacitor, and the other end of the other band-shaped conductor is connected to the ground by a second resistor and a second capacitor, and the capacity value of the first capacitor and the capacity value of the second capacitor are set to be different from each other. Accordingly, the transmission of a signal in the reverse direction can be prevented over a wide frequency band.

Further, each of the first central conductor and the second central conductor is constructed by two parallel band-shaped conductors, and the respective distances between the two band-shaped conductors in the first to third central conductors are equally arranged. Accordingly, each of the central conductors is easily manufactured.

What is claimed is:

1. An isolator comprising a magnetic core of a plate shape placed within a direct current magnetic field and having an upper face perpendicular to a direction of said direct current magnetic field, and first, second, and third central conductors placed so as to be overlapped with each other at an equal angle interval approximately in a central portion of the upper face of said magnetic core, and respectively having one end connected to ground, wherein another end of said first central conductor is set to an input terminal, another end of said second central conductor is set to an output terminal, at least said third central conductor is constructed by two parallel band-shaped conductors, one end of one band-shaped conductor is connected to the ground by a first resistor and a first capacitor, one end of the other band-shaped conductor is connected to the ground by a second resistor and a second capacitor, and a capacity value of said first capacitor and a capacity value of said second capacitor are set to be different from each other.

2. The isolator according to claim 1, wherein each of said first central conductor and said second central conductor is constructed by two parallel band-shaped conductors, and respective distances between the two band-shaped conductors in said first, second, and third central conductors are equally arranged.

* * * * *